United States Patent [19]

Ladriere

[11] Patent Number: 4,708,063

[45] Date of Patent: Nov. 24, 1987

[54] PROJECTILES INTENDED TO BE FIRED BY A FIRE-ARM

[76] Inventor: Serge Ladriere, Avenue du Cap Roux, 06360 Eze-sur-Mer, France

[21] Appl. No.: 878,503

[22] PCT Filed: Nov. 24, 1983

[86] PCT No.: PCT/FR83/00228

§ 371 Date: Jul. 18, 1984

§ 102(e) Date: Jul. 18, 1984

[87] PCT Pub. No.: WO84/02183

PCT Pub. Date: Jun. 7, 1984

Related U.S. Application Data

[63] Continuation of Ser. No. 634,103, Jul. 18, 1984.

[30] Foreign Application Priority Data

| | | | |
|---|---|---|---|
| Nov. 24, 1982 | [FR] | France | 82 19658 |
| Dec. 14, 1982 | [FR] | France | 82 20907 |
| Jun. 15, 1983 | [FR] | France | 83 09895 |

[51] Int. Cl.[4] ..... F42B 11/14

[52] U.S. Cl. ..... 102/516; 102/518

[58] Field of Search ..... 102/501, 506–510, 102/514–519

[56] References Cited

U.S. PATENT DOCUMENTS

| | | | |
|---|---|---|---|
| 388,496 | 8/1888 | Langfitt | 102/519 |
| 1,021,685 | 3/1912 | Knaebel | 102/430 |
| 1,322,662 | 11/1919 | Watson | 102/510 |
| 1,556,160 | 10/1925 | Riggs | 102/510 |
| 2,123,981 | 7/1938 | Whipple | 102/508 |

FOREIGN PATENT DOCUMENTS

| | | | |
|---|---|---|---|
| 370908 | 3/1923 | Fed. Rep. of Germany . | |
| 609594 | 2/1935 | Fed. Rep. of Germany . | |
| 393079 | 12/1908 | France | 102/501 |
| 445864 | 11/1912 | France . | |
| 29354 | 7/1925 | France | 102/501 |
| 2425621 | 12/1979 | France . | |
| 6785 | of 1912 | United Kingdom . | |

OTHER PUBLICATIONS

The PPI Phenomenon by SFM (no date).

S.F.M., L'effet PPI, Defense & Armement, 12/84, p. 31.

*Primary Examiner*—Harold J. Tudor

*Attorney, Agent, or Firm*—Larson and Taylor

[57] ABSTRACT

The projectile comprises a central core, a rear body of which the diameter determines the gauge of the projectile, and an interlock for the central core with the rear body. This interlock comprises a conical sleeve coupling formed by a conical recess and a conical finger, having complementary shapes arranged to provide a self-clamping effect. The rear body comprises at least one bulge cooperating with the gun barrel of the armament and at least one hollow. The bulge and hollow being interconnected progressively so as to define a continuous sinuous shape.

10 Claims, 14 Drawing Figures

Fig.3c.
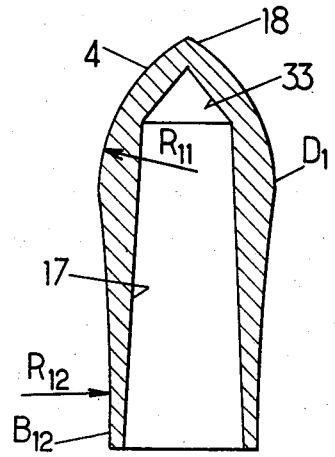
Fig.3b
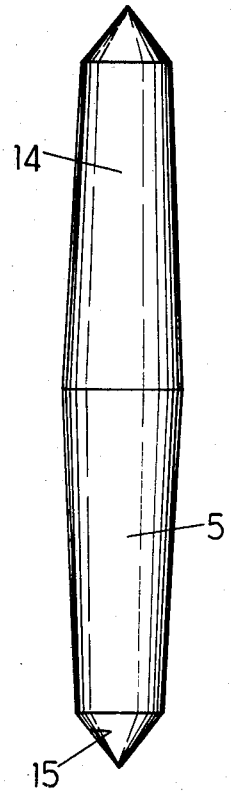
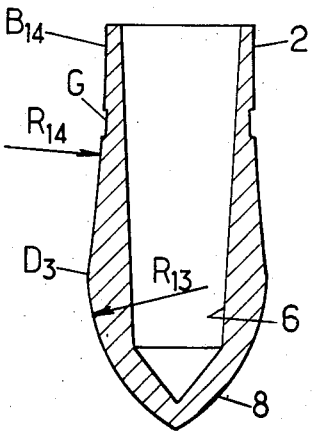
Fig.3a.

PROJECTILES INTENDED TO BE FIRED BY A FIRE-ARM

This is a continuation of application Ser. No. 634,103, filed July 18, 1984.

FIELD OF THE INVENTION

The invention relates to projectiles intended to be fired by a fire-arm, comprising a central core, a rear body whose diameter determines the caliber of the projectile and interlocking means between said central core and said rear body.

BACKGROUND OF THE INVENTION

A problem which arises in projectiles of this type resides in the construction of these interlocking means which must be such that, from the mechanical point of view, the projectile may behave, when it is fired more especially by a weapon with rifled barrel, as a monobloc projectile.

Another problem which arises in projectiles of this type resides in the arrangement of its rear body which must be connected to the case and which must cooperate, once firing has been initiated, with the barrel of the weapon.

SUMMARY OF THE INVENTION

To resolve these problems, the interlocking means comprise, on the one hand, a conical sleeve coupling formed by a conical housing and a conical finger of complementary shapes and, on the other hand, an axial abutment surface; and the rear body comprises at least one swelling cooperating with the barrel of the weapon and at least one hollow, this swelling and this hollow being joined up to each other progressively so as to define a profiled shape.

With the self-clamping effect of the conical sleeve coupling and the retaining effect of the axial abutment surface, the projectile behaves then, during firing, like a monobloc projectile. This is particularly noticeable if the projectile is fired from a weapon with rifled barrel for, at the moment when it is set in rotation when the rear body engages in the rifling, the angular acceleration is transmitted without any loss by sliding between the rear body and the central core.

It is thus possible to form this projectile in two parts, which allows a choice to made of the material forming the central core (hard, semi-hard or soft material), and a choice of the material forming the rear body (material adapted for cooperation with the barrel of the weapon under the best possible conditions), while keeping the advantages of a monobloc projectile from the ballistics point of view.

In particular, a projectile may be formed which presents a high penetration force because of its ballistics characteristics, and high expansion effects because of the possibilities of shape and choice of material offered by its two-part construction.

Furthermore, because of the external construction of the rear body of the projectile, and the shape of the swelling which it comprises, on the one hand an increase in the pressure after combustion of the powder charge may be obtained. This occurs because of better efficiency of crimping the case to the projectile, resulting in better sealing between the projectile and the internal wall of the chamber of the weapon. In addition a progressive rifling may be obtained, when the projectile reaches the rifled wall of the weapon, for this rifling takes place with a small axial deceleration.

In so far as crimping the case to the projectile is concerned, it may be made on the rear body either at the level of the swelling, or at the level of the hollow, which in both cases improves efficiency thereof.

The aerodynamic characteristics of the projectile are improved with respect to a conventional projectile because of the fact that marking of the rear body by the barrel only affects the swelling of this rear body and generates a parasite drag considerably smaller than that noted in a conventional projectile.

It can then be readily seen that the projectile of the invention presents characteristics of accuracy and power, more especially in so far as its initial speed and its impact speed are concerned. These characteristics of accuracy and power are substantially greater than those of a conventional projectile. Moreover, the life-span of the barrel of the weapon firing projectiles in accordance with the invention is improved. In particular when it is a question of a weapon with rifled barrel, this improvement occurs because of the progressiveness of the rifling phenomenon which is allowed by the outer shape of the rear body of the projectile.

According to another advantageous arrangement of the invention, the conical finger is provided on the central core and the conical housing is formed in the rear body.

From the constructional point of view, the conical sleeve coupling has advantageously an axial extent at least equal to its mean diameter and, preferably, twice greater than its mean diameter.

The angle of this conical sleeve coupling is preferably between 3° and 25°.

A conical sleeve coupling may also be used which comprises two different tapers.

In an advantageous arrangement of the invention, the swelling and the hollow formed in the rear body of the projectile further define a profiled shape with its central core.

In another advantageous arrangement of the invention, the swelling and the hollow formed in the rear body of the projectile define a profiled shape with a front body fitted on a front conical part of the central core.

Advantageously, the rear body comprises a succession of swelling separated by hollows. The radii of curvature respectively of the swelling and of the hollows may be equal to each other.

The conical housing provided in the rear body may open into the rear face of said rear body, the conical finger of the central body than extending as far as said rear face. The conical finger then comprises a conical bore for a fixing flange provided with a conical tang having a shape complementary to that of said conical bore.

In so far as the central core is concerned, it may have a conical shape ending in a rounded tip or a profiled shape ending in a pointed tip.

Advantageously, the central core may have a front conical part with a shape symmetrical to that of the conical finger. This conical front part is then capped by a front body in which is provided a conical housing adapted to fit on said conical front part. This front body having a shape substantially symmetrical to that of the rear body.

The invention will, in any case, be well understood from the complement of the description which follows as well as from the accompanying drawings, which description and drawings are relative to preferred embodiments of the invention and of course comprise no limiting character.

BRIEF DESCRIPTION OF THE DRAWINGS

FIGS. 3*a*, 3*b*, 3*c* show respectively, in section, the three component parts of the projectile of FIG. 3.

DETAILED DESCRIPTION OF THE PREFERRED EMBODIMENTS

Figure 1:
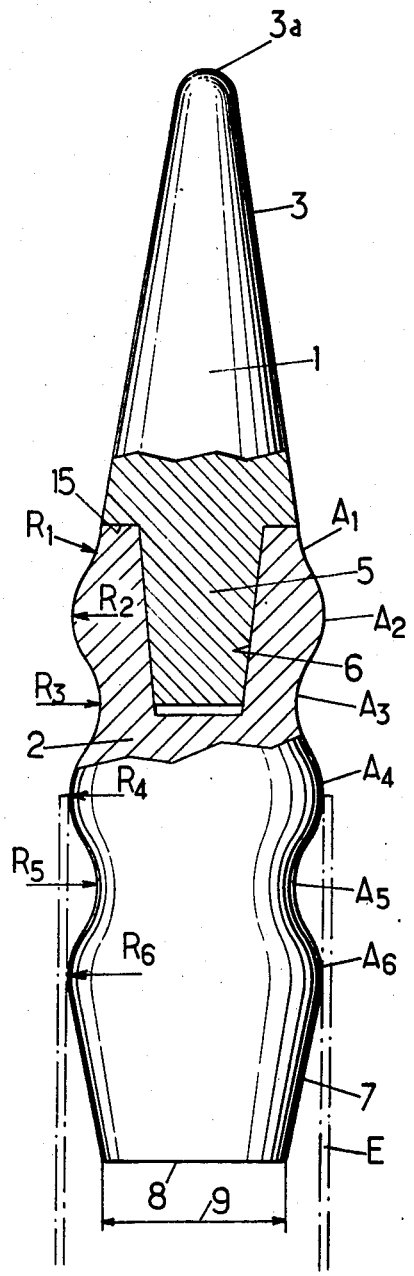
FIG. 1, shows an axial section of a projectile constructed in accordance with a first embodiment of the invention.

As shown in these figures, the projectile comprises a central core 1, a rear body 2 whose diameter determines the caliber of the projectile and interlocking means between said central core 1 and said rear body 2.

These interlocking means comprise:

on the one hand, a conical sleeve coupling 6,5 formed by a conical housing 6 and a conical finger 5 of complementary shapes, and, on the other hand, an axial abutment surface 15.

The rear body 2 comprises, in all embodiments at least one swelling such as swellings $A_2$ $A_4$,$A_6$,$D_3$,$B_2$,$B_4$ cooperating with the barrel of the weapon and at least one hollow such as hollows $A_3$,$A_5$,$B_{14}$,$B_3$. Each swelling and hollow being connected together progressively so as to define a profiled shape.

Figure 1B:
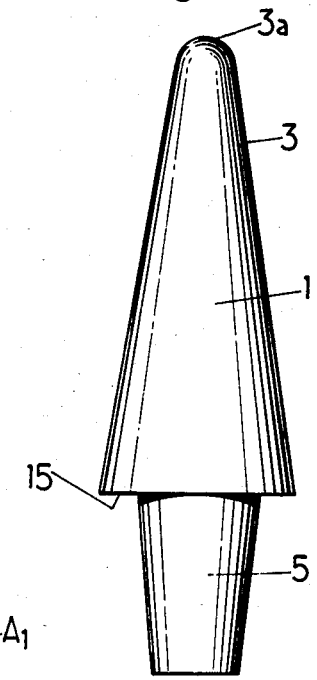
FIGS. 1*a* and 1*b* show respectively, in section, the two component parts of the projectile of FIG. 1.
Figure 1A:
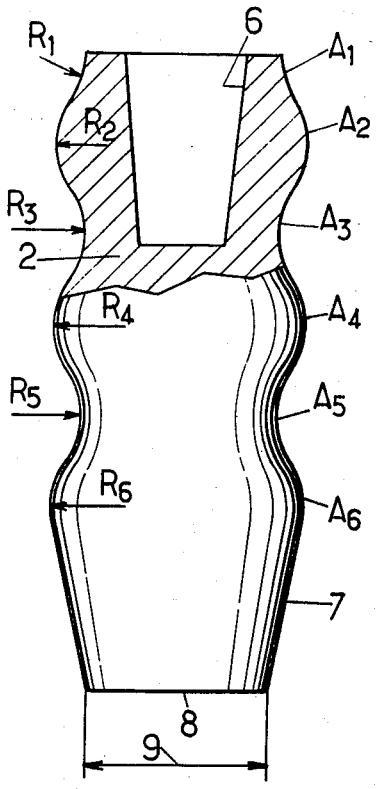
Figure 2:
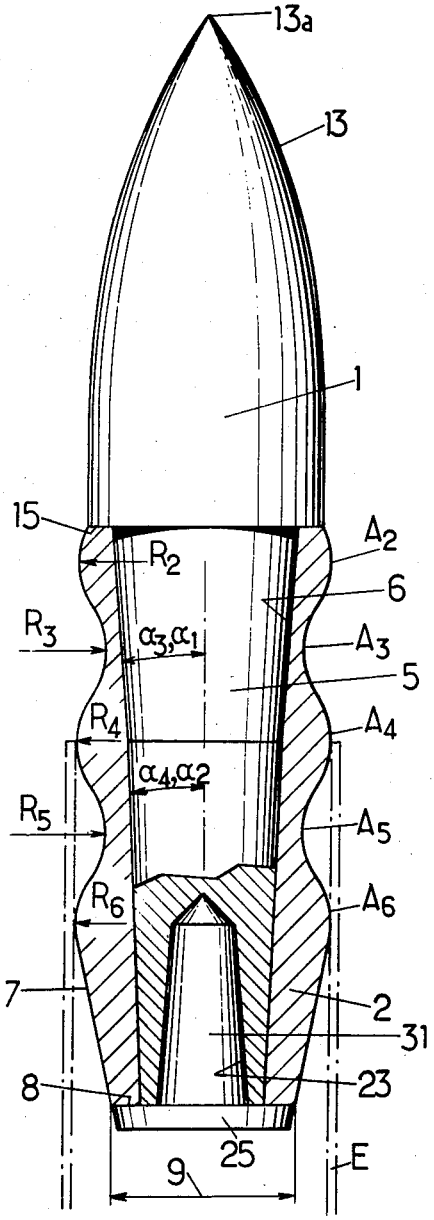
FIG. 2 shows an axial section of a projectile constructed in accordance with a second embodiment of the invention.
Figure 2B:
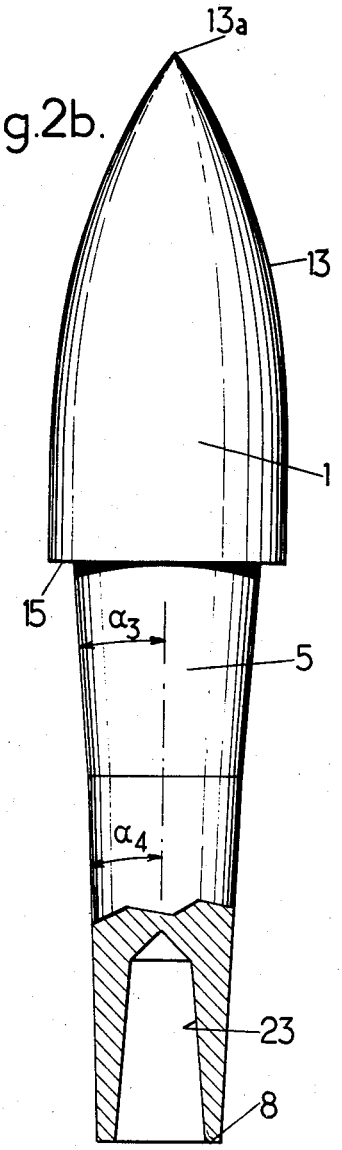
FIGS. 2*a*, 2*b*, 2*c* show respectively, in section, the three component parts of the projectile of FIG. 2.
Figure 2A:
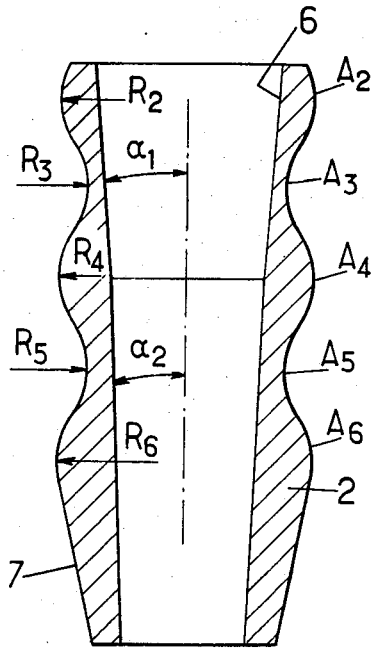
Figure 2C:
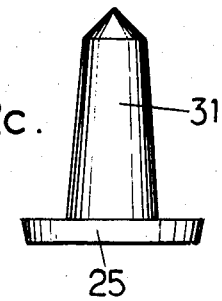
Figure 3:
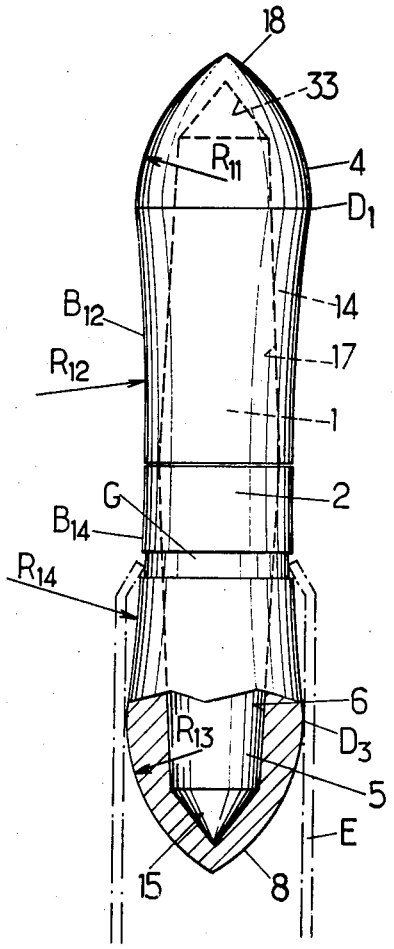
FIG. 3 shows an axial section of a projectile constructed in accordance with a third embodiment of the invention.
Figure 4:
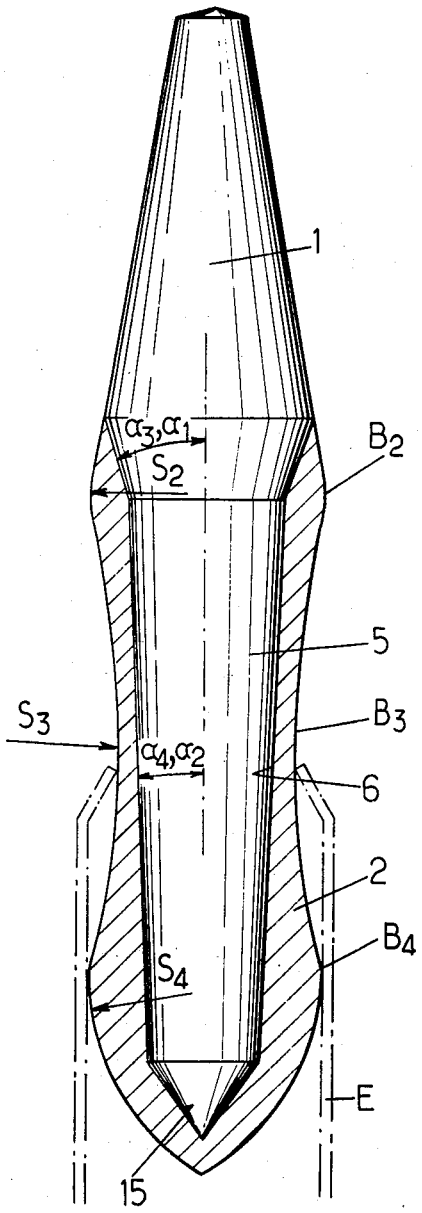
FIG. 4 shows an axial section of a projectile constructed in accordance with a fourth embodiment of the invention.
Figure 4A:
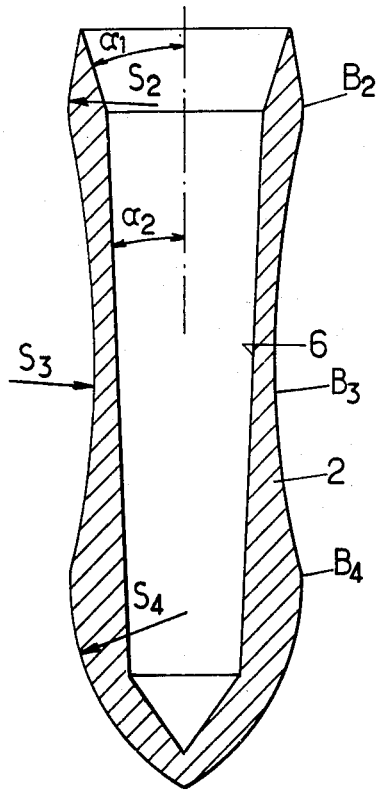
FIGS. 4*a* and 4*b* show respectively, in section, the two component parts of the projectile of FIG. 4.
Figure 4B:
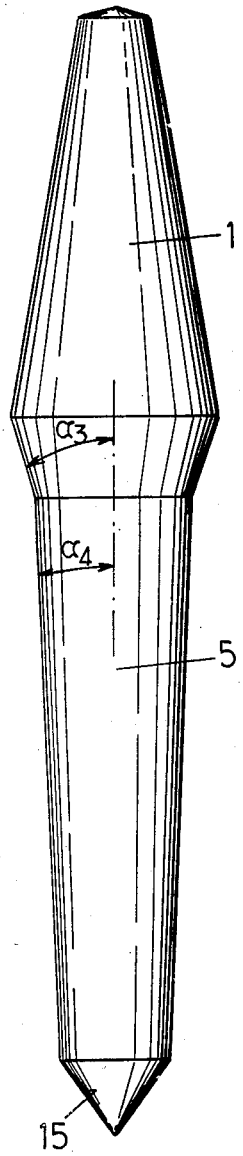

According to the embodiments illustrated respectively in FIGS. 1, 1*a*, 1*b*, in FIGS. 2, 2*a*, 2*b*, 2*c*, in FIGS. 3, 3*a*, 3*b*, 3*c* and in FIGS. 4, 4*a*, 4*b*, the conical finger 5 is formed on the central core 1 and the conical housing 6 is formed in the rear body 2.

According to the embodiments illustrated respectively in FIGS. 1, 1*a*, 1*b*, in FIGS. 2, 2*a*, 2*b*, and in FIGS. 4, 4*a*, 4*b*, the swellings $A_2$,$A_4$,$A_6$,$B_2$,$B_4$ and the hollows $A_3$, $A_5$, $B_3$ formed in the rear body 2 further define a profiled shape with the central core 1.

According to the embodiment illustrated in FIGS. 3, 3*a*, 3*b*, 3*c*, the swelling $D_3$ and the hollow $B_{14}$ formed in the rear body 2 further define a profiled shape with a front body 4 fitted on to a conical front part 14 of the central core 1.

According to the embodiments shown respectively in FIGS. 1, 1*a*, 1*b*, and in FIGS. 2, 2*a*, 2*b*, 2*c*, the rear body 2 comprises a succession of swellings $A_2$,$A_4$,$A_6$, separated by hollows $A_3$, $A_5$.

The radii of curvature $R_2$, $R_4$, $R_6$ of swellings $A_2$, $A_4$, $A_6$ are equal to each other and equal to the radii of curvature $R_3$, $R_5$ of the hollows $A_3$, $A_5$.

In the embodiment illustrated in FIGS. 1, 1*a*, 1*b*, the first swelling $A_2$ of the rear body 2 is connected to the central core 1 by a connecting portion $A_1$ having a radius of curvature $R_1$ equal to the radius of curvatures $R_2$ of swelling $A_2$.

In the embodiments illustrated in FIGS. 1, 1*a*, 1*b* and in FIGS. 2, 2*a*, 2*b*, 2*c*, the last swelling $A_6$ of the rear body 2 is joined to the rear face 8 of said rear body 2 by a conical connecting portion 7 tangent to said swelling $A_6$.

In these two embodiments, the diameter 9 of the rear face 8 of the rear body 2 is equal to twice the radius of curvature $R_6$ of the last swelling $A_6$ of the rear body 2.

As clearly shown in FIGS. 1 and 2, the projectile may be intended to be crimped to a case E. When this occurs, case E is crimped to the rear body 2, on an intermediate swelling $A_4$ between the first swelling $A_2$ and the last swelling $A_6$.

As shown in the embodiment illustrated in FIGS. 2, 2*a*, 2*b*, 2*c*, the conical housing 6 formed in the rear body 2 opens into the rear face 8 of said rear body 2 and the conical finger 5 of the central body 1 extends as far as said rear face 8. The conical finger 5 in this case comprises a conical bore 23 for fixing to a flange 25. Flange 25 has a conical tang 31 whose shape is complementary to that of the conical bore 23.

The conical sleeve coupling 6,5 may then comprise two different tapers as clearly shown in FIGS. 2, 2*a*, 2*b* as well as in FIGS. 4, 4*a*, 4*b*.

The conical finger 5 formed on the central core 1 has first of all a taper $\alpha_3$ and then a taper $\alpha_4$ less than $\alpha_3$ while the conical housing 6 formed in the rear body 2 has first of all a taper $\alpha_1$ equal to $\alpha_3$ then a taper $\alpha_2$ equal to $\alpha_4$ (FIGS. 2, 2*a*, 2*b* and 4, 4*a*, 4*b*).

As shown in FIGS. 1 and 1*b*, the central core 1 has a conical shape 3 ending in a rounded tip $3_a$.

As shown in FIGS. 2 and 2*b*, the central core 1 has a profiled shape 13 ending in a pointed tip $13_a$.

In the embodiment illustrated in FIGS. 3, 3*a*, 3*b*, 3*c*, the central core 1 has a front conical part 14 whose shape is symmetrical with that of the conical finger 5. This conical front part 14 is then capped by the front body 4 in which a conical housing 17 is formed for fitting on to this front conical part 14. This front body 4 has a shape substantially symmetrical to that of the rear body 2.

In this embodiment, the front body 4 has a swelling $D_1$ whose diameter is equal to or slightly less than the diameter of swelling $D_3$ of the rear body 2.

As shown in FIGS. 3, 3*a* and 3*c*, the rear face 8 of the rear body 2 has a profiled shape with radius of curvature $R_{13}$ joined to swelling $D_3$ and the front face 18 of the front body 4 has a profiled shape with radius of curvature $R_{11}$ joined to the swelling $D_1$. These radii of curvature $R_{13}$ and $R_{11}$ are equal.

As can also be seen in said figures, the rear body 2 has, towards the front, a thinned down profiled shape formed by a hollow $B_{14}$ of radius of curvature $R_{14}$ joined to the rear of the front body 4. The front body 4 has, towards the rear, a thinned down profiled shape formed by a hollow $B_{12}$ of radius of curvature $R_{12}$ joined to the front of the rear body 2. These radii of curvature $R_{14}$ and $R_{12}$ are equal.

As clearly shown in FIG. 3, the projectile may be intended to be crimped to a case E. As shown, the case E is crimped to the rear body 2 in the hollow $B_{14}$ situated in front of swelling $D_3$.

A shallow groove G may then be provided at this location in said rear body.

The front part 14 of the central core 1 cooperates with the front body 4 through an axial abutment surface 33.

As shown in the embodiment illustrated in FIGS. 4, 4*a*, 4*b*, the rear body 2 comprises a rear swelling $B_4$ situated towards the rear, a front swelling $B_2$ situated towards the front and having a diameter equal to or slightly less than the diameter of the rear swelling $B_4$, and a thinned down zone formed by the hollow $B_3$ joined to these two swellings $B_2$, $B_4$.

As shown in these figures, the radius of curvature $S_4$ of the rear swelling $B_4$ is greater than or equal to the radius of curvature $S_2$ of the front swelling $B_2$, and the radius of curvature $S_3$ of the thinned down zone $B_3$ is greater than or equal to the radius of curvature $S_2$ of the front swelling $B_2$.

As shown in FIG. 4, the projectile may be intended to be crimped to a case E. As shown, the case E is crimped to the rear body 2 in the hollow $B_3$ situated between the front swelling $B_2$ and the rear swelling $B_4$.

Whatever the embodiment, the invention provides a projectile whose advantages are clearly indicated in the introduction to the description which has just been made.

In addition, it should be emphasized that the ease of manufacture allows a projectile to be obtained of low price compared with conventional projectiles.

In so far as the fields of application are concerned, it should also be noted that it is possible to produce:

projectiles of any caliber formed in accordance with the invention; and projectiles of any kind formed in accordance with the invention, more especially ordinary projectiles, penetrating projectiles, incendiary penetrating projectiles, tracer incendiary penetrating projectiles, incendiary projectiles, tracer projectiles, explosive projectiles.

What is claimed is:

1. A unitary armor-penetrating projectile intended to be fired at a high velocity by a fire-arm having a rifled barrel, consisting of:

a central core constituting the effective portion of the projectile and having a smooth nose and a frusto-conical rear end decreasing in diameter from a front to a rear, said central core being made of an armor-penetrating material;

a one-piece rear body constituting a rifling engaging jacket around said rear end of said central core said jacket being formed of a single rifling engaging material which is softer than the armor-penetrating material, said rear body having (a) a central frusto-conical bore along substantially all its length which bore decreases in diameter from a front of said rear body to an abutment surface in said rear body at a bottom of said bore, the dimensions and angles of said frusto-conical rear end and of said frusto-conical bore being essentially identical for allowing a tight penetration of said rear end into said bore and a relative self-tightening between said frusto-conical rear end of said central core and said frusto-conical bore of said rear body after firing of the projectile in the firearm due to the relative axial and rotational movement of said central core and said rear body produced by a firing, and (b) at least two peripheral swellings having outermost portions cooperating with the riflings of the barrel and at least one peripheral hollow therebetween, said swellings and hollow being joined progressively together so as to define a continuous sinuous shape, the thickness of said rear body at said outermost portions being sufficient to prevent said central core from contacting the rifle barrel during firing; and abutment means provided at the rear of said central core for axially abutting said central core in said bore to said abutment surface of said rear body.

2. A unitary projectile according to claim 1, characterized by the fact that said frusto-conical bore and said frusto-conical rear end both have two distinct tapered portions.

3. A unitary projectile according to claim 1, wherein the rear body comprises (a) a rear swelling having a diameter and a radius of curvature which is situated towards the rear, (b) a front swelling having a diameter and a radius of curvature which is situated towards the front, said diameters being approximately equal to each other, and (c) a thinned down zone formed by the hollow joining these two swellings.

4. A unitary projectile according to claim 3, wherein the radius of curvature of said rear swelling is greater than the radius of curvature of said front swelling.

5. A unitary projectile according to claim 3, wherein the radius of curvature of the hollow is greater than the radius of curvature of the front swelling.

6. A unitary projectile according to claim 1 wherein the angle of taper of said frusto-conical rear end and of said frusto-conical bore is in the range of 3°–5°.

7. A unitary projectile according to claim 6, wherein the angle of taper is of about 5° and wherein said frusto-conical bore is laterally centered in said rear body allowing the lateral centering of the central core in the rear body and the driving of the central core by the rear body.

8. A unitary projectile as claimed in claim 1 and further including a second abutment means at the frontmost location where said central core and said rear body meet.

9. A unitary projectile as claimed in claim 1 wherein said swelling adjacent said central core defines a continuous sinuous shape with said central core.

10. A unitary projectile as claimed in claim 8 wherein the maximum diameter of said central core is greater than the minimum diameter of said swelling.

* * * * *